US008308446B2

(12) United States Patent
Tang et al.

(10) Patent No.: US 8,308,446 B2
(45) Date of Patent: Nov. 13, 2012

(54) SMART BLOW-DOWN SYSTEM FOR VARIABLE FREQUENCY DRIVE COMPRESSOR UNITS

(75) Inventors: Yan Tang, Daphne, AL (US); Steven DeWayne Centers, Daphne, AL (US)

(73) Assignee: Quincy Compressor LLC, Pine Brook, NJ (US)

( * ) Notice: Subject to any disclaimer, the term of this patent is extended or adjusted under 35 U.S.C. 154(b) by 487 days.

(21) Appl. No.: 12/098,332

(22) Filed: Apr. 4, 2008

(65) Prior Publication Data

US 2008/0317607 A1 Dec. 25, 2008

Related U.S. Application Data

(60) Provisional application No. 60/907,544, filed on Apr. 6, 2007.

(51) Int. Cl.
*F04B 49/02* (2006.01)

(52) U.S. Cl. ..... 417/292

(58) Field of Classification Search ..... 417/292, 417/279, 306; 236/61, 92 C
See application file for complete search history.

(56) References Cited

U.S. PATENT DOCUMENTS

| | | | | |
|---|---|---|---|---|
| 5,113,892 | A * | 5/1992 | Hull et al. | 137/62 |
| 6,082,971 | A * | 7/2000 | Gunn et al. | 417/32 |
| 6,379,122 | B1 * | 4/2002 | Little | 417/292 |
| 6,471,486 | B1 * | 10/2002 | Centers et al. | 417/18 |
| 6,533,552 | B2 * | 3/2003 | Centers et al. | 417/12 |
| 7,210,312 | B2 * | 5/2007 | Unger | 62/640 |
| 2005/0235661 | A1 * | 10/2005 | Pham | 62/126 |

* cited by examiner

*Primary Examiner* — Devon Kramer
*Assistant Examiner* — Bryan Lettman
(74) *Attorney, Agent, or Firm* — Holland & Hart LLP

(57) ABSTRACT

A method and apparatus for blowing down a compressed air system when temperature is at or below a predefined temperature threshold is provided. Temperature sensors in the compressed air system monitor temperature and a control processor determines when the temperature is at or below the predefined temperature threshold. When it is determined temperature is at or below the predefined temperature threshold, the control processor operates a solenoid blow-down valve that depressurizes the compressed air system.

7 Claims, 2 Drawing Sheets

SMART BLOW-DOWN SYSTEM FOR VARIABLE FREQUENCY DRIVE COMPRESSOR UNITS

CLAIM OF PRIORITY UNDER 35 U.S.C. §119

The present application for patent claims priority to Provisional Application No. 60/907,544 entitled "SMART BLOW-DOWN SYSTEM FOR VARIABLE FREQUENCY DRIVE COMPRESSOR UNITS" filed Apr. 6, 2007, and assigned to the assignee hereof and hereby expressly incorporated by reference herein.

REFERENCE TO CO-PENDING APPLICATIONS FOR PATENT

None.

BACKGROUND

1. Field

The technology of the present application relates generally to the field of a blow-down system for a variable frequency drive compressor unit.

2. Background

When a compressor stops it blows down the pressure in the sump. If there is a demand for air, the compressor will need to start up again and build pressure back up in the sump before it can deliver air to the air system. In order to save energy, compressed air can be saved in a sump when the compressor stops. If the compressor does not start up for a while, the sump can be dumped, i.e., "blown-down," by using a release value, such as, for example, a solenoid, in a separator tank. If the pressurized air is left in the sump, it can begin to leak. As a result, conventional systems typically will either not have any blow-down when the compressor unit shuts down or only have a blow-down whenever the compressor unit stops.

A conventional variable frequency drive (VFD) compressor unit can cycle (i.e., shutdown and start-up) with a high frequency when the compressed air demand is low. With every shutdown, the sump is normally blown-down. In other words, the compressed air, which is typically about, 100 to 150 psi inside sump, is evacuated to atmosphere. This blow-down causes energy loss, lubricant loss, and it is not environmentally friendly.

A blow-down is not necessary for a VFD compressor unit to restart. The VFD compressor unit can start up under full sump pressure. When the VFD compressor unit is blown-down, the compressed air inside the VFD compressor unit can cause moisture condensation, which can cause compressor unit parts (e.g., bearings) to rust and can reduce the service life of the compressor unit and lubrication fluid.

What is desired is a compressor unit that minimizes the amount of blow-downs in order to save energy, be more environmentally friendly, and extend the life of the compressor unit and its components.

DETAILED DESCRIPTION

Figure 1:
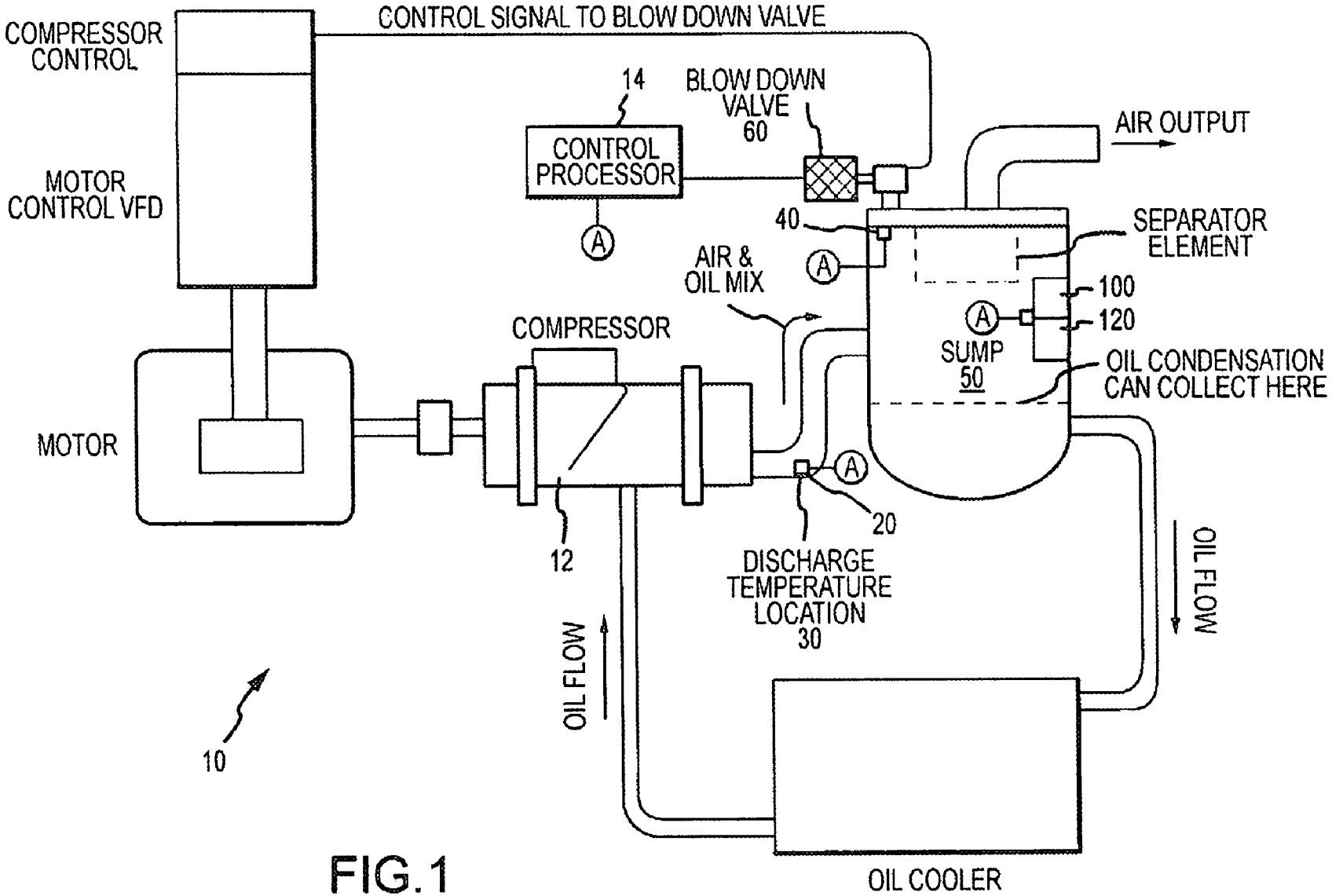
FIG. 1 is a functional block diagram of a compressor system exemplary of the technology of the present application.

Reference will now be made in detail to exemplary embodiments of the technology of the present application.

The word "exemplary" is used herein to mean "serving as an example, instance, or illustration." Any embodiment described herein as "exemplary" is not necessarily to be construed as preferred or advantageous over other embodiments. In other words, each example is provided by way of explanation of the technology and should not be construed as a limitation thereof. It now will be recognized by one of ordinary skill in the art on reading the disclosure that various modifications and variations can be made in the present invention without departing from the scope or spirit of the invention. For example, features illustrated or described as part of one embodiment of the invention can be used on another embodiment to yield a still further embodiment. Thus, it is intended that the present invention cover such modifications and variations that come within the scope of the invention.

In one exemplary embodiment described herein, the technology of the present application may be used in conjunction with a variable frequency drive compressor unit, hereinafter VFD compressor unit. When using a VFD compressor unit, the compressor unit typically can be stopped and started quickly, in the order of seconds. When the compressor unit stops, the pressure may be, in some embodiments, dropped. However, in these same systems, it may be required to restart the VFD compressor while, or shortly after, dropping the pressure. In other words, the VFD compressor may need to cycle on quickly. If the compressor unit will only be stopped for a short period of time, it may be beneficial to hold the pressure instead of dropping the pressure.

If the temperature of the air in the sump drops to a temperature below the dew point, the water vapor in the air can begin to condense in the sump and mix with the lubricating oil. With sufficient agitation, as is generally known in the art, the water and oil mixture may turn amalgamous and cause foaming. The foam like substance may be detrimental to the systems. For example, the foam like substance may degrade the bearings. Moreover, the amalgamated mixture may saturate a separation element that separates oil from the air. Saturating the separation element results in decreased efficiency of the separation element. Decreasing the efficiency of the separation element may allow for oil to escape to the atmosphere (i.e., "oil carryover").

One way of preventing condensation of the water vapor in the sump once the compressor shuts down may including blowing the system down when temperature reaches a predetermined temperature threshold. The predetermined temperature may be set to a reasonably safe value or variable depending on humidity, pressure, and other known factors relating to dew point. The dew point for the compressed air is typically higher than an associated dew point for ambient air. For example, the dew point for compressed air in the sump at about 150 psi can be approximately 150° F. or more. In one exemplary embodiment of the technology, the predetermined temperature threshold is set at 150° F. However, the predetermined temperature threshold may be set at a value greater than 150° F. to ensure no condensation occurs. For example, the dew point for 150 psi system may be set at any of 155, 172, 180, 194° Fs. Temperature and pressure vary in a known way, so systems having pressures of more or less than 150 psi would be determinable using any conventionally known technique to determine dew point. The predetermined temperature threshold would be set at or slightly above the dew point temperature for the pressure of the system.

Referring now to FIG. 1, an exemplary compressor system 10 is provided. Compressor system 10 operates in a conventional manner with the exception of the blow-down controls.

Thus, the operation of compressor system 10 will not be explained with the exception of how it relates to the present technology described herein.

Compressor system 10 includes a compressor 12 having a discharge or outlet 30. In this exemplary embodiment, a temperature sensor 20 is located in the discharge or outlet 30 of compressor 12. Temperature at outlet 30 is typically close to temperature in the sump. In many systems 10, temperature at outlet 30 is within 3 to 5° F. of sump temperature. Another temperature sensor 40 may be located in the sump.

After the compressor system 10 shuts down, pressure may be maintained in the system to reduce the need to blow-down the compressor system 10 for the reasons identified above and more. Temperature sensors 20 and 40 monitor the air temperature of the pressurized air. Temperature sensors 20 and 40 would typically provide input to a control processor 14, that may be any conventional control processor such as, for example, a laptop computer, a desktop computer, a service, a micro controller, or the like. The control processor 14 would compare the temperature to determine if temperature drops below a predefined temperature threshold as identified above determining whether temperature drops below a predefined temperature threshold may involve averaging the temperature sensors 20 and 40, if either temperature sensor 20 or 40 drops below the predefined temperature threshold, if both temperature sensors drop below the predefined temperature threshold or a combination thereof. Once control processor 14 determines temperature, as sensed by temperature sensors 20 and 40, drops to or below a predefined temperature threshold, control processor 14 would send a control signal to blow-down valve 60 to cycle the blow-down valve 60 cycling the blow-down valve would depressurize and blow-down sump 50. Blow-down valve 60 may be any conventional valve, such as, for example, a solenoid valve.

When the logic state is at "0," a logic output B0625 for blowing-down the sump causes a blow-down. A reference input U005 provides a fixed reference point of 60.5%, which refers to 60.5% of 300° F. This percent is equal to 181.5° F. A control K0405 provides the reference point temperature to a control B0473. Within a fan motor control, if a discharge temperature is less than the reference temperature of 181.5° F., then the logic state at control B0473 is changed from a "0" to a "1." An output signal 80644 provides a signal to input signal U245. If the logic state changes from "1" to "0," then the system blows-down if the compressor is stopped. The system will continue to blow-down as long as the discharge temperature is below 181.5° F. and the compressor is stopped.

As mentioned above, pressure may bleed or leak from the sump for a variety of reasons. As pressure decreases, the associated dew point changes as well. Thus, it would be possible to provide a pressure sensor 100 in sump 50. Pressure sensor 100 would provide a pressure signal to control processor 14. Control processor would calculate the predefined temperature threshold based on actual pressure instead of system operating pressure. Other sensors 120 may also be used as inputs to determine the actual dew point for the system. Other sensors 120 may include, for example a humidity sensor or the like.

Figure 2:
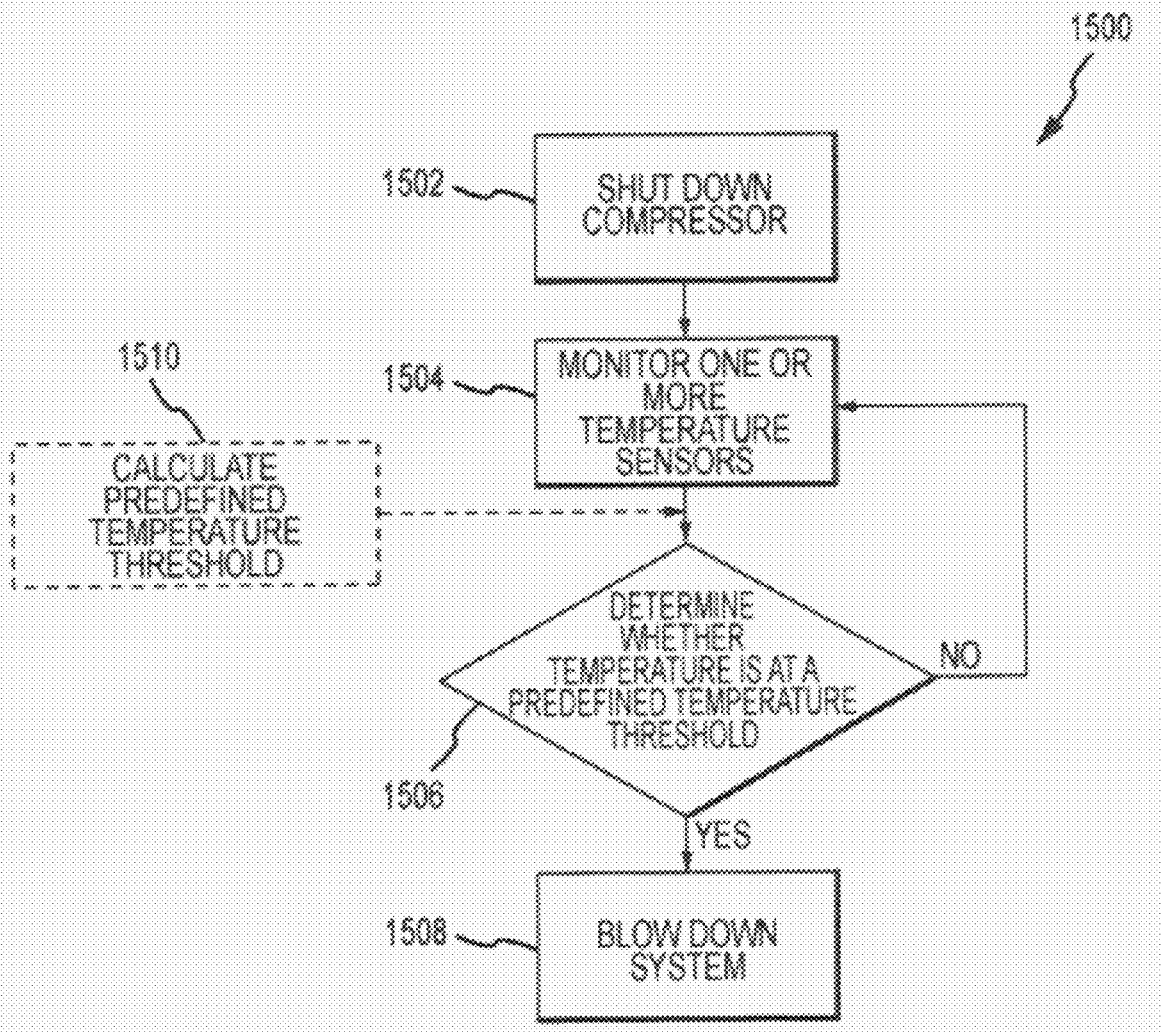
FIG. 2 is a flow chart illustrating exemplary operating steps associated with the technology of the present application.

Referring now to FIG. 2 an exemplary flowchart 1500 illustrating exemplary operational steps of the technology of the present application are provided. Compressor system 10 is shut down, step 1502. Shutting down compressor system simply means compressor 12 is not operating to maintain pressure in the system in this exemplary description. Once compressor 12 is shut down, temperature sensors continually, iteratively, or the like monitor temperature in the system, step 1504. The control processor determines whether temperature is at or below a predefined temperature threshold, step 1506. If temperature is at or below a predefined temperature threshold, the system is blown down, step 1508. Optionally, other factors may be used to calculate the predefined temperature threshold used, step 1510.

As a result, the compressor system as described herein can have advantages and improvements over conventional systems, such as the system may provide an optimized energy savings and increased reliability of the compressor system. By reducing the amount of blow-downs, the system may achieve energy savings and less lubrication fluid may be used. Accordingly, the compressor system may be more environmentally friendly as less energy may be used and less lubricant vapor may be used. The system also may assist with avoiding compressor system component rust or degradation.

Furthermore, the dissipation of heat in the compressor system can take a relatively long period. The system described herein may avoid any frequent blow-downs (e.g., once a minute, once a day, or the like). Additionally the system can be configured to only blow-down when desirable for the purposes of compressor system reliability. For example, the system will not postpone blow-down if condensation begins collecting.

Those of skill in the art would understand that information and signals may be represented using any of a variety of different technologies and techniques. For example, data, instructions, commands, information, signals, bits, symbols, and chips that may be referenced throughout the above description may be represented by voltages, currents, electromagnetic waves, magnetic fields or particles, optical fields or particles, or any combination thereof.

Those of skill would further appreciate that the various illustrative logical blocks, modules, circuits, and algorithm steps described in connection with the embodiments disclosed herein may be implemented as electronic hardware, computer software, or combinations of both. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the present invention.

The various illustrative logical blocks, modules, and circuits described in connection with the embodiments disclosed herein may be implemented or performed with a general purpose processor, a Digital Signal Processor (DSP), an Application Specific Integrated Circuit (ASIC), a Field Programmable Gate Array (FPGA) or other programmable logic device, discrete gate or transistor logic, discrete hardware components, or any combination thereof designed to perform the functions described herein. A general purpose processor may be a microprocessor, but in the alternative, the processor may be any conventional processor, controller, microcontroller, or state machine. A processor may also be implemented as a combination of computing devices, e.g. a combination of a DSP and a microprocessor a plurality of microprocessors, one or more microprocessors in conjunction with a DSP core, or any other such configuration.

The steps of a method or algorithm described in connection with the embodiments disclosed herein may be embodied directly in hardware, in a software module executed by a processor, or in a combination of the two. A software module may reside in Random Access Memory (RAM), flash memory, Read Only Memory (ROM), Electrically Programmable ROM (EPROM), Electrically Erasable Programmable ROM (EEPROM), registers, hard disk, a removable disk, a CD-ROM, or any other form of storage medium known in the art. An exemplary storage medium is coupled to the processor such the processor can read information from, and write information to, the storage medium. In the alternative, the storage medium may be integral to the processor. The processor and the storage medium may reside in an ASIC. In the alternative, the processor and the storage medium may reside as discrete components in a user terminal.

The previous description of the disclosed embodiments is provided to enable any person skilled in the art to make or use the present invention. Various modifications to these embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein.

What is claimed is:

1. An apparatus to depressurize a compressed air system, including a compressor and a sump, to inhibit water condensing in the compressed air system after the compressor is shut down, the apparatus comprising:

at least one temperature sensor, at least one blow-down valve; and a control processor, such that the at least one temperature sensor is adapted to provide a temperature indication of the compressed air system while the compressor is shut down to the control processor and the control processor determines whether the temperature is at or below a predefined temperature threshold, the control processor to operate the at least one blow-down valve when the temperature is at or below the predefined temperature threshold and the compressor is shut down, wherein operation of the at least one blow-down valve is adapted to depressurize the compressed air system including the sump to atmospheric pressure subsequent to the compressor being shut down.

2. The apparatus of claim 1 wherein the at least one temperature sensor comprises a plurality of temperature sensors wherein the control processor determines whether the temperature is at or below the predefined temperature threshold if at least one of the plurality of temperature sensors indicates the temperature is at or below the predefined temperature threshold.

3. The apparatus of claim 1 wherein the at least one temperature sensor comprises a plurality of temperature sensors wherein the control processor determines whether the temperature is at or below the predefined temperature threshold if all of the plurality of temperature sensors indicate the temperature is at or below the predefined temperature threshold.

4. The apparatus of claim 1 comprising a pressure sensor adapted to provide a pressure of the compressed air system to the control processor such that the control processor can calculate the predefined temperature threshold based on the pressure of the compressed air system.

5. The apparatus of claim 1 wherein the at least one blow-down valve is a solenoid valve.

6. The apparatus of claim 1 wherein the control processor is selected from a group of control processors consisting of: a desktop computer, a laptop computer, a server, a microcomputer, or a microprocessor.

7. An apparatus to depressurize a compressed air system, including a compressor and a sump, to inhibit water condensing in the compressed air system after the compressor is shut down, the apparatus comprising:

means for sensing a temperature of the compressed air system, means for blowing down the compressed air system;

means for determining that the temperature of the compressed air system is at or below a predetermined temperature threshold while the compressor is shut down; and means for operating the means for blowing down the compressed air system such that the compressed air system including the sump is depressurized to atmospheric pressure when it is determined that the temperature of the compressed air system is at or below the predetermined threshold subsequent to the compressor being shut down.

* * * * *